US005080233A

United States Patent [19]

Wyberg

[11] Patent Number: 5,080,233

[45] Date of Patent: Jan. 14, 1992

[54] GABLE TOP CONTAINER HAVING REDUCED OPENING FORCE AND METHOD FOR CONSTRUCTION THEREFOR

[75] Inventor: Gregory R. Wyberg, Minneapolis, Minn.

[73] Assignee: Minnesota Mining and Manufacturing Company, St. Paul, Minn.

[21] Appl. No.: 616,423

[22] Filed: Nov. 21, 1990

[51] Int. Cl.[5] ..... B65D 5/74

[52] U.S. Cl. ..... 229/214; 229/208; 53/412

[58] Field of Search ..... 229/125.42, 133, 137, 229/125.42, 138; 206/621.1, 629, 631.2, 631.3; 493/184; 53/412

[56] References Cited

U.S. PATENT DOCUMENTS

| | | | |
|---|---|---|---|
| 2,329,797 | 9/1943 | Strack | 229/51 |
| 2,634,896 | 4/1953 | Graveno | 229/17 |
| 3,144,195 | 8/1964 | Hennessey | 229/51 |
| 3,167,231 | 1/1965 | Bray | 229/17 |
| 3,186,621 | 6/1965 | Svensson | 229/17 |
| 3,232,514 | 2/1966 | Swede et al. | 229/17 |
| 3,295,739 | 1/1967 | Wilcox | 229/17 |
| 3,347,444 | 10/1967 | Rausing et al. | 229/17 |
| 3,559,800 | 2/1971 | Butler | 206/629 |
| 3,770,185 | 11/1973 | Reeves | 229/17 G |
| 3,869,078 | 3/1975 | Braun | 229/17 R |
| 3,892,347 | 7/1975 | Egleston | 229/17 R |
| 4,244,474 | 1/1981 | Wise | 206/612 |
| 4,248,351 | 2/1981 | Berg | 206/620 |
| 4,294,362 | 10/1981 | Martensson | 206/622 |
| 4,410,128 | 10/1983 | Rausing | 229/17 R |
| 4,442,970 | 4/1984 | Farber | 229/17 G |
| 4,520,929 | 6/1985 | Lisiecki | 206/610 |
| 4,527,732 | 9/1985 | Smith | 229/17 G |
| 4,756,426 | 7/1988 | Wyberg | 229/125.42 |
| 4,762,234 | 8/1988 | Wyberg | 206/631.3 |
| 4,787,507 | 11/1988 | Rausing | 206/617 |
| 4,792,048 | 12/1988 | Wyberg | 229/125.42 |
| 4,813,546 | 3/1989 | Gordon et al. | 206/621.2 |
| 4,842,188 | 6/1989 | Lisiecki | 229/123.3 |
| 4,903,891 | 2/1990 | Gordon | 206/631.2 |
| 4,919,272 | 4/1990 | Kai et al. | 206/629 |
| 4,982,846 | 1/1991 | Friedman | 206/621 |

*Primary Examiner*—Stephen Marcus
*Assistant Examiner*—Christopher J. McDonald
*Attorney, Agent, or Firm*—Gary L. Griswold; Walter N. Kirn; Leland D. Schultz

[57] ABSTRACT

A gable-top container including a weakened line formed in one of the facing surfaces of the first and second upper rib panels to induce controlled delamination of one of the first and second upper rib panels during opening of the pouring spout, to reduce the force required to open the pouring spout.

33 Claims, 4 Drawing Sheets

GABLE TOP CONTAINER HAVING REDUCED OPENING FORCE AND METHOD FOR CONSTRUCTION THEREFOR

TECHNICAL FIELD

The present invention relates to a gable top container and more particularly, to a gable top container having a reduced opening force.

BACKGROUND ART

Containers for beverages such as milk, fruit juices, and drinks are conventionally constructed from blanks of thermoplastic coated paperboard. The most widely used of such containers have a rectangular cross-sectional body surmounted by a gable-top closure incorporating an extensible pouring spout. Blanks from which the containers are constructed are divided into a plurality of panels which are adapted to form the walls and closure members. The panels are formed and separated by score lines at which the blank is folded. Particular panels are intended to be joined together in a lapped arrangement in the completed container. Typically, those panels are pressed together and heated or exposed to high frequency radiation to fuse the adjoining thermoplastic surfaces and form a generally strong seal. To finally seal the filled container, two or more panels are finally joined and sealed to form a rib along the top edge of the roof panels. Exemplary of such container blanks are those shown in Alden U.S. Pat. No. 2,750,095 and Wilcox U.S. Pat. No. 3,245,603.

Containers of this type are opened for access to the contents by a two-step toggle action process. First, the gable edges of the roof panels at the front of the container are pushed outward and upward toward the rear of the container by thumb pressure, breaking the seal between the outside surfaces of the two lip panels, and breaking the seal in the rib panels surmounting the roof above the pouring spout. The gable edges are forced backward past the point at which the lip panels are joined, to nearly touch the roof panels.

Second, the gable edges are pushed forward and towards each other. The forces are communicated through spout panels to the tip of the pouring spout, breaking the seal between the lip panels and the underside of the roof panels and snapping the spout outward to a pouring position.

Typically, the highest level of resistance is encountered during the initial breaking of the seal of the pouring spout panels at the onset of the first phase of the opening process described hereinabove. The remainder of the first phase involves a continued opening at an elevated level of force, although reduced somewhat from the initial opening force. The second phase, that of extending the panels of the pouring spout forward to enable dispensing of the contents of the gable-top container, exhibits a further reduced level of opening force, compared to the previous levels.

In early models of gable-top containers, the panels comprising the lips of the pouring spout were bonded to the underside of the roof panels. The resulting sealed spout was difficult to open, generally requiring insertion of a tool behind the lips to separate them from the roof underside. The cardstock panels often tore or delaminated in an uncontrolled manner, producing an unsightly and unsanitary container. In those cases where an adhesive was applied to only those panels which were to be joined, it was simple to eliminate adhesive from the spout panels to reduce the forces required to open the spout. The resulting container, of course, was not effectively sealed and was subject to leakage.

An improvement in gable-top containers to provide a hermetic seal for an extended shelf life package consisted of coating the inner surface of the container blank with a metallic foil and an overcovering layer of thermoplastic such as polyethylene. The panels to be sealed are bonded by heating the thermoplastic surface coatings to a softening or melting temperature, compressing the panels together and cooling. The use of thermoplastic coatings or foil adds some stiffness to the panels, and the container is made resistant to wicking by liquids. However, the strong bonding of the lip panels results in uncontrolled and irregular buckling, tearing and delamination of the cardstock upon opening the seal. Thus, the spout is difficult to open, and the opened panels are unappealing in appearance.

As used in the food packaging industry, the term hermetic refers to a container designed and intended to be secure against the entry of oxygen which degrades flavor. The term is also used to designate containers used for aseptic filling and storage, i.e. containers secure against the entry of microorganisms. The hermetic barrier of such cartons typically comprises an aluminum or other barrier film coating the inner surface, overcovered with a thermoplastic such as polyethylene. The carton wall thickness is thus increased, resulting in larger channels where the edges of overlying panels have a stepped relationship in the gable rib area, increasing the chance for leakage.

Attempts to provide an easily opened spout seal have included (a) perforations in the spout panels which tear open to expose pouring lips, (b) improved control of the sealing temperature, (c) the use of added scoreline patterns to concentrate the opening forces, and (d) the use of anti-adhesion agents, i.e. abhesives, to reduce the required opening forces.

The use of perforations in the spout panels has generally been unsatisfactory. Such perforations produce a spout of reduced size, which requires special sealing operations. The perforations are considered by some to be a weak point in the carton, prone to develop leaks. This type of carton spout requires external forces such as thumbnail pressure to open, and this procedure is considered unsanitary. The carton cannot be effectively closed, once opened, and shaking of the carton results in spillage.

Likewise, efforts to reduce temperature variations in the sealing process have not produced a satisfactory hermetic sealing gable-top container. Because of narrow acceptable temperature range for obtaining the desired adhesion, sealing variations persist in spite of improved temperature control. Moreover, the required opening forces generally exceed the panel strength, even where minimal sealing is achieved.

The use of novel scoreline patterns generally has not overcome the strong sealing forces of well-sealed spouts and buckling of the spout panels is common.

One method for preventing the difficulty in opening the completely bonded lip panels of polyethylene coated gable-top containers is shown in Crawford et al, U.S. Pat. No. 3,116,002. In this reference, a thin coating of a high molecular weight organo-siloxane gum is applied to the lip panels as an abhesive, that is, to prevent permanent adhesion to the panels in contact with the lip panels.

Egleston et al, U.S. Pat. No. 3,270,940 discloses the use of an anti-adhesive composition applied to both the outside and inside surfaces of the pouring lip of a gable-top container. Abhesive agents disclosed include cellulose plastic laminated to polyethylene, the latter heat-bondable to the polyethylene surface of the cardstock blank.

The release properties of abhesives are generally affected by the heat sealing parameters and are inconsistent. Containers designed for hermetic use and having adhesives in the spout sealing area often require opening forces greater than the wall strength of the panels, and the spout panels buckle during the opening process.

The problems of conventional gable-top containers in this respect is aggravated by containers such as are disclosed in U.S. Pat. No. 4,787,507, the contents of which are incorporated herein by reference. The gable-top container of the '507 patent is representative of gable-top constructions that incorporate new and/or additional layers that enhance the properties of the container in regard to flavor retention, prevention of oxygen penetration, or other like features that increase the shelf life, integrity and freshness of the contents of the container. However effective these new and/or additional layers may be for their intended purpose, they also inherently introduce additional toughness and tear resistance to the gable-top container thus formed and at the same time increase the force required to open the gable-top container thus constructed, particularly during the first phase of the opening process described above, after the initial separation of the pouring spout panels.

Thus, it is desirable to provide a gable-top container having a reduced opening force. This problem is not adequately solved by any of the conventional gable-top container designs, and in particular with gable-top containers constructed from higher strength laminates.

DISCLOSURE OF INVENTION

The present invention provides a gable-top container having a thermoplastic inner surface coating. The gable top container includes a container body having sides, a bottom and a top. The gable-top container also includes an extensible pouring spout including a generally triangular end panel connected to the container body top and extending upwardly therefrom, first and second foldback panels, the first foldback panel connected to the container body top and to one lateral edge of the first triangular end panel, and the second foldback panel connected to the container body top and to the other lateral edge of the first triangular end panel, first roof wing panel adjoining the first foldback panel and connected thereto, a second roof wing panel adjoining the second foldback panel and connected thereto, a first roof rib panel connected to the first roof panel and the first roof wing panel, a second roof rib panel connected to the second roof panel and the second roof wing panel, a first upper rib panel connected to an upper edge of the first roof rib panel and a second upper rib panel connected to an upper edge of the second roof rib panel. The uppermost end of the first triangular end panel and the first and second foldback panels forming a tip of the pouring spout. The invention further includes means for inducing controlled delamination of one of said first and said second upper rib panels when the pouring spout is being opened to reduce the force required to open the pouring spout.

In one embodiment, means for inducing delamination includes a weakened line formed a facing surface in one of the first and second upper rib panels, wherein when the first and the second upper rib panels are separated, a portion of the upper rib panel with the weakened line delaminates and remains adhered to the other upper rib panel so as to reduce the force for separating said first and second upper rib panels from each other.

The present invention further provides a sheet material blank for constructing the sealed gable-top container with the means for inducing delamination of the first and the second upper rib panels.

The present invention also provides a method for constructing the gable-top container of this invention, comprising the steps of: (a) providing a sheet material gable-top container blank including a container body having side panels, a bottom and a top and an extensible pouring spout including a generally triangular end panel connected to the container body top and extending upwardly therefrom, first and second foldback panels, the first foldback panel connected to the container body top and to one lateral edge of the first triangular end panel, and the second foldback panel connected to the container body top and to the other lateral edge of the first triangular end panel, a first roof wing panel adjoining the first foldback panel and connected thereto, a second roof wing panel adjoining the second foldback panel and connected thereto, a first roof rib panel connected to the first roof panel and the first roof wing panel, a second roof rib panel connected to the second roof panel and the second roof wing panel the uppermost end of the first triangular end panel and the first and second foldback panels forming a tip of said pouring spout, a first upper rib panel connected to an upper edge of the first roof rib panel and a second upper rib panel connected to an upper edge of the second roof rib panel; and (b) forming a weakened line in an inner surface of one of the first and second upper rib panels to induce delamination of the first and the second upper rib panels as the pouring spout of the gable-top container is opened, to reduce the force required to open the gable-top container. The method may further include the steps of: (c) forming the gable-top container blank into a gable-top container; and (d) sealing the pouring spout of the gable-top container.

BRIEF DESCRIPTION OF THE DRAWINGS

The present invention will be further described with reference to the accompanying drawing wherein like reference numerals refer to like parts in the several views, and wherein.

DETAILED DESCRIPTION

Figure 1:
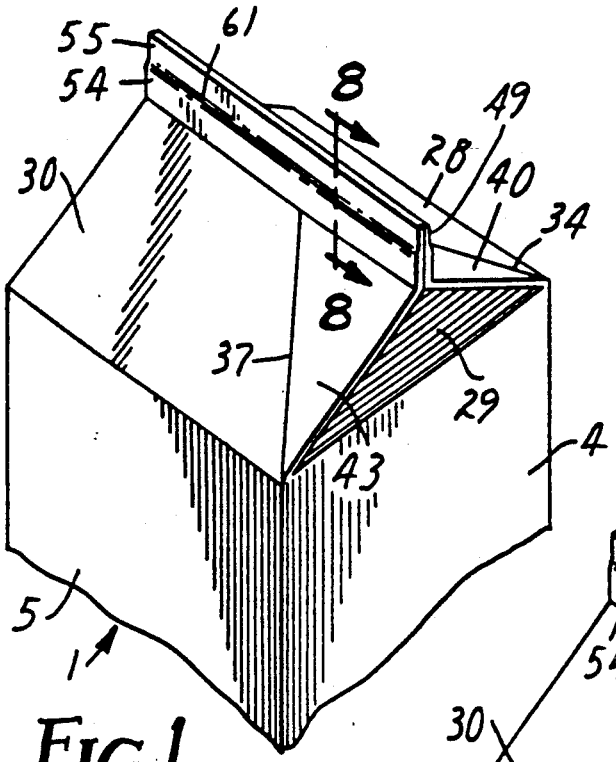
FIG. 1 is a perspective view of the upper end of a closed container constructed according to the present invention.

Referring now to the drawing, a gable-top container is depicted. FIG. 1 shows a typical container 1 in a closed, sealed condition as for storage of beverages and the like. The container is self-sustaining in shape and is hermetically sealed. It is also within the spirit and scope of the present invention to provide a gable top container that is liquid or moisture proof, but not hermetically sealed, or alternatively, to provide a gable-top container that merely acts as closed receptacle for its contents. Container 1 is comprised of a series of panels, including a container body having four body panels 2–5. Front body panel 4 and second side body panel 5 are shown in FIG. 1, while rear body panel 2 and first side body panel 3, not shown, oppose panels 4 and 5, respectively, forming a container of rectangular cross-section. Usually, the cross-section is square. The bottom of the container 1 is closed. First roof panel 28 is connected to the upper edge of first side panel 3. Second roof panel 30 is connected to the upper edge of second side panel 5. When the container is in the closed condition, the roof panels 28 and 30 converge upwardly to form a gable roof construction. Roof rib panel 54 is attached to roof panel 30 and extends upwardly therefrom. Likewise, upper rib panel 55 is attached to roof rib panel 54 and extends upwardly therefrom.

First triangular end panel 29 is connected to the upper edge of the front body panel 4. When the container is closed, end panel 29 is folded under the gable roof formed by the two roof panels. Also shown are first roof wing panel 40 and second roof wing panel 43. The roof wing panels 40 and 43 are subpanels of roof panels 28 and 30, respectively. A second triangular end panel, not shown in this Figure, is usually adapted to remain folded under the opposite gable roof, unless it is desired to open both gable ends of the container.

Figure 2:
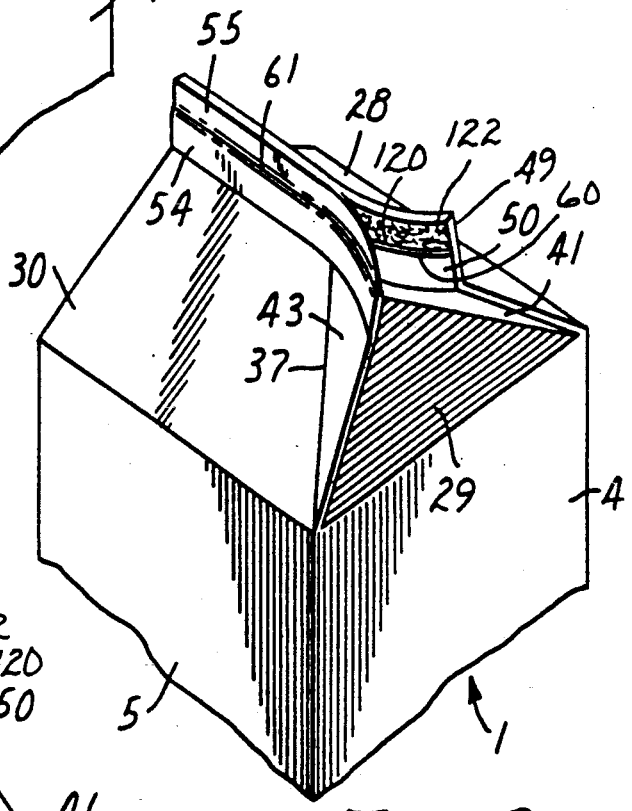
FIG. 2 is a perspective view of the container end of FIG. 1 with a partially opened rib.

FIG. 2 shows the container of FIG. 1 in which the spout has been partially opened. The first and second foldback panels 41 and 42 and overlapping roof wing panels 40 and 43 are typically pushed outward and backward with thumb pressure to break the seal between the inner surfaces of the first and second upper rib panels 49 and 55, and between the outer surfaces of the first and second gable rib panels 50 and 52, the latter not visible in this drawing. The gable rib panels are connected to the upper edge of foldback panels 41 and 42, and extend upwardly therefrom.

Figure 3:
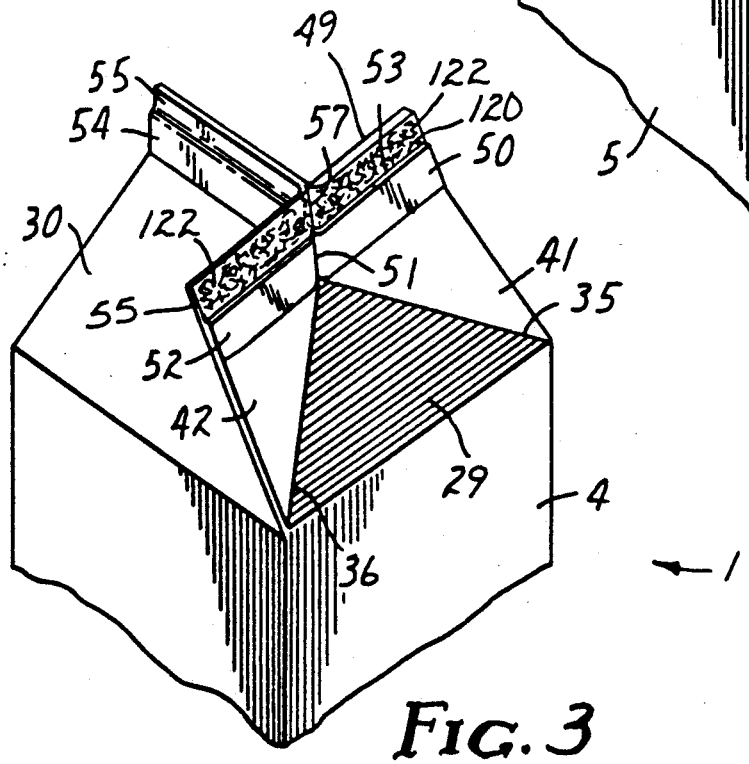
FIG. 3 is a perspective view of the container end of FIG. 1 with its sealed rib fully open and the spout panels in the closed position.

FIG. 3 shows the container at the point where foldback panels 41 and 42 have been pushed backward about 90 degrees from their sealed position. These panels are roughly triangular in shape, each having one edge defined by scoreline 35 or 36, where they are attached to a lateral edge of first triangular end panel 29. First and second gable rib panels 50 and 52 act as lips of the pouring spout, and meet at a common gable rib score line 51. The upper terminus 51A of the common rib score line at the free edge 53 of the pouring lip comprises the tip of the pouring spout. First and second upper rib panels 49 and 55 extend upwardly from the first and second roof rib panels 48 and 54 to a level higher than the free upper edge 53 of gable rib panels 50 and 52.

To complete the unsealing and opening of container 1, foldback panels 41 and 42 are pushed backward beyond the position shown in FIG. 3. The roof rib panels and upper rib panels will fold along foldline 57. The blank may or may not be scored at that location.

The gable rib panels are slightly longer than the roof rib panels. Thus, after the panels are folded backward, a subsequent forward and inward movement of wing panels 40 and 43 transmits opening forces in a toggle-like action along the wing panels and gable rib panels 50 and 52 toward the common line 51 between the gable rib panels. A component of these forces extends outward and upward from line 51 and from gable score lines 35 and 36 to pull the gable rib panels 50 and 52 away from roof rib panels 54 and 48, the latter not visible in FIG. 3, and to pull foldback panels 41 and 42 away from roof wing panels 40 and 43. Likewise, triangular end panel 29 is forced outward, and the distended panels create a pouring spout (not shown). The various score lines delineating the panels act as hinges for the panels as they are unfolded.

Analysis of the opening forces is complex. In general however, the gable rib panels, foldback panels, and roof rib panels must be relatively stiff to prevent the panels from crumpling, and to transmit the applied opening forces to common line 51. The sealing forces which bond the gable rib panels to the roof rib panels are preferably only as high as required to maintain the hermetic seal. Excessive bonding forces will require greater stiffness in the spout panels to prevent crumpling of the panels during the opening process.

Figure 4:
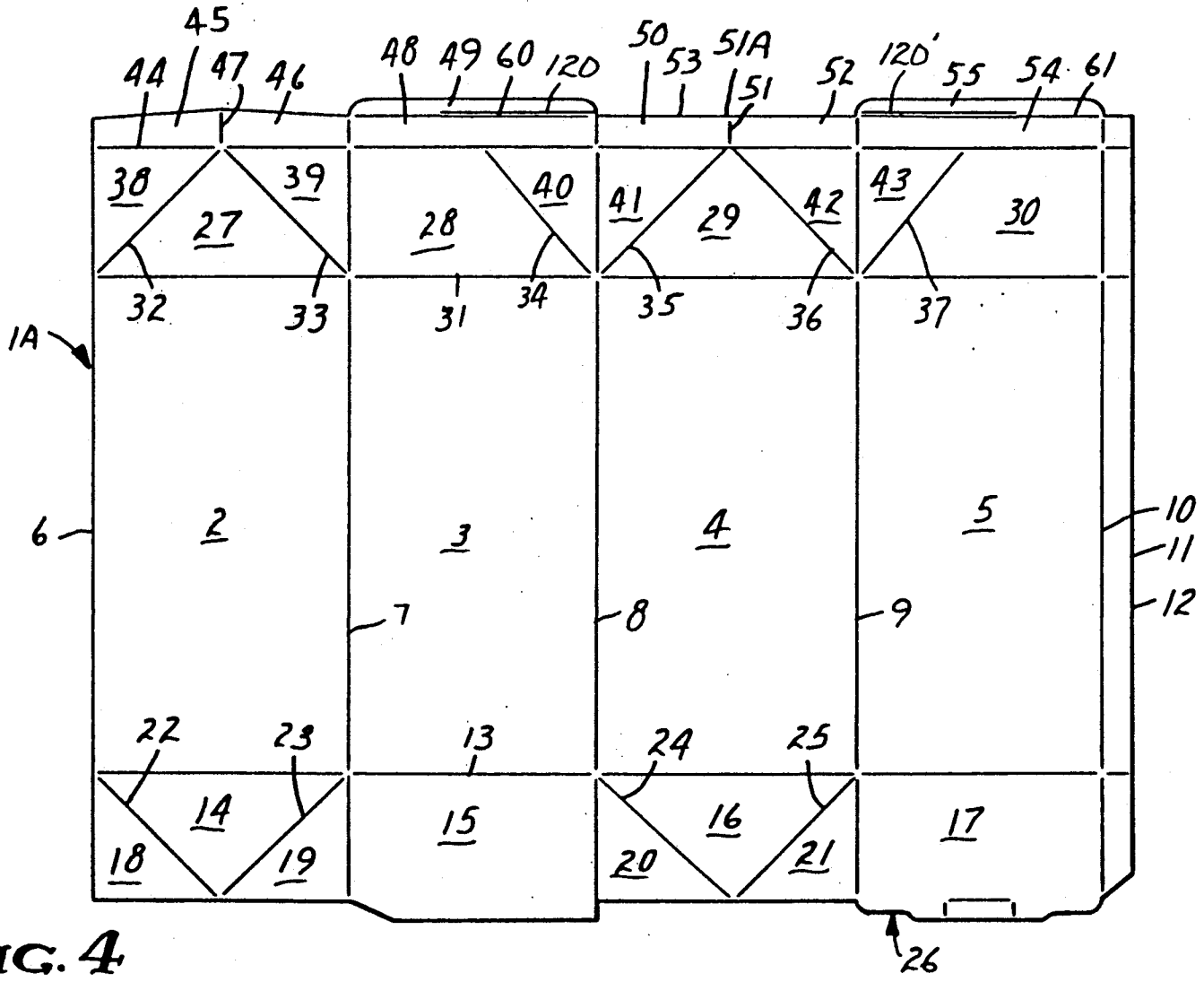
FIG. 4 is a plan view of an embodiment of a conventional container blank with a weakened line formed in an inner surface of one of the first and second upper rib panels of the pouring spout.

FIG. 4 illustrates an exemplary flat sheet material blank for constructing a gable-top container as shown in FIGS. 1–3. The inner surface or face is shown. An appropriate pattern of score lines divides blank 1A into a plurality of panels and sub-panels which are used as walls of the container and its closure parts when the container is erected.

The central portion of blank 1A comprises four body panels 2, 3, 4, and 5, having their lower edges along bottom score line 13, and their upper edges along top score line 31. These transverse score lines are shown as extending from blank edge 6 to opposite blank edge 12 in substantially parallel relationship across the face of the blank. Vertical score lines 7, 8 and 9 transect the blank to define the lateral edges of the body panel 2, 3, 4 and 5, and other panels above the body panels. These and other score lines are not necessarily straight, but may be slightly offset in certain sectors of the blank to improve the fit of the various panels in the erected container.

In the example shown in FIG. 4, side seam flap 11 is connected to one lateral edge 10 of a body member for sealing to the edge of another body member 2 by the container sealing process. Bottom closure means 26 is shown as a group of bottom closure panels 14 through 21 attached to the body members along bottom score line 13, and extending downward therefrom. Bottom closure score lines 22 through 25 enable bottom closure panels 14, 16, and 18–21 to be folded under closure panels 15 and 17 and sealed to provide a leakproof container bottom. Such a closure means is well-known in the art. A separately formed structure may alternatively be used to close the bottom of the container. In fact, any closure means which results in a satisfactorily tight seal may be used.

The gable-top of the container is formed from a series of panels above top score line 31. First and second roof panels 28 and 30 are connected to the upper edges of the first and second side panels 3 and 5, respectively. The roof panels are oppositely disposed and when erected, converge upwardly to meet along score line 44 to form a gable roof. Connected to the upper edge of the front panel 4 is a first substantially triangular end panel 29 whose two lateral edges 35 and 36 formed by score lines extend upwardly to score line 44. Similarly, second triangular end panel 27 is connected to the upper edge of back panel 2, and has lateral edges 32 and 33 which extend upwardly to score line 44.

On each side of triangular end panel 29 is a foldback panel. First foldback panel 41 is connected to triangular end panel 29 along edge 35, and to first roof wing panel 40 along score line 8. Panel 41 has a score line 44 as its upper edge. Similarly, second foldback panel 42 is connected to triangular end panel 29 along edge 36, and to second roof wing panel 43 along score line 9. It has score line 44 as its upper edge.

Similarly, third and fourth foldback panels 39 and 38 are connected to triangular end panel 27 along lateral edges 33 and 32, respectively. The third foldback panel 39 is attached to the first roof panel 28 along score line 7, and the fourth foldback panel 38 is connected to the second roof panel 30 by side seam flap 11 when the container is erected.

Attached to the upper edge of each foldback panel 38, 39, 41 and 42 along score line 44 is a gable rib panel 45, 46, 50 and 52, respectively. Similarly, attached to the upper edge of first and second roof panels 28 and 30 are first and second roof rib panels 48 and 54, respectively. First and second gable rib panels 50 and 52 are connected to each other at a common score line 51, and third and fourth gable rib panels 46 and 45 are connected to each other at common score line 47. The uppermost end 51A of line 51 is the tip of the pouring spout of the erected container.

First gable rib panel 50 is connected to first roof rib panel 48 at score line 8, and second gable rib panel 52 is connected to second roof rib panel 54 at score line 9.

First roof wing panel 40 comprises a triangular portion of first roof panel 28 defined by score lines 34, 44 and 8, and is adjacent first foldback panel 41. Second roof wing panel 43 comprises a triangular portion of second roof panel 30 defined by score lines 37, 44 and 9 and is adjacent second foldback panel 42. These roof wing panels are more or less coextensive with the adjacent foldback panel when the erected container is closed.

A first upper rib panel 49 is connected to the upper edge of the first roof rib panel 48. Likewise, a second upper rib panel 55 is connected to the upper edge of the second roof rib panel 54. The score lines 60 and 61 separate the upper rib panels from the adjacent roof rib panels, and are substantially continuous with the free upper edge 53 of the first and second gable rib panels 50 and 52. The latter panels serve as lips of the pouring spout of the erected container.

The score lines may be applied to blank 1A before or after the thermoplastic coating is applied to the blank. The score lines may be applied to either surface or both surfaces of the blank. For purposes of clearer delineation of the various panels, score lines are shown in the drawings on either or both of the inner and outer surfaces of the blank and container.

First and second roof rib panels 48 and 54 overlie first and second gable rib panels 50 and 52. The gable rib panels are separated from foldback panels 41 and 42 by scorelines 44, and the roof rib panels are likewise separated from roof wing panels 40 and 43 by scorelines 44. Upper rib panels 49 and 55 are separated by score lines 60 and 61 from the roof rib panels 48 and 54, and extend upwardly therefrom.

When the first sealing process is thermal in nature, the upper rib panels, the gable rib panels, and the roof rib panels are heated to the softening or melting point of the thermoplastic coating, and then compressed together in a manner known in the art (not shown). The upper rib panels are bonded on their inner surfaces at interface 69, and gable rib panels 50 and 52 are preferably mutually bonded on their outer surfaces at interface 70.

Second roof panel 30 and first roof panel 28 converge upwardly so that their upper edges 44 meet or almost meet. Roof rib panels 48 and 54 are sealed along approximately one-half of the length of the rib structure, and enclose third and fourth gable rib panels 45 and 46. When the container is closed, common scoreline 47 between the third and fourth gable rib panels is somewhat spaced from common scoreline 51. The void between those scorelines is a vertical channel which when filled with adhesive will prevent leakage. First and second upper rib panels 49 and 55 are joined by the container sealing process. The spout panels of the rib structure are shown to have been opened by breaking the seal between the upper rib panels 49 and 55, and the seal between gable rib panels 50, 52 and roof rib panels 48, 54. First triangular end panel 29, and first and second foldback panels 41 and 42 are folded outward to extend the pouring spout (not shown).

The pouring spout may take various forms in various gable-top configurations, but generally includes the first triangular end panel, the first and second foldback panels and the first and second roof wing panels or equivalent components. In the illustrated embodiment, the pouring spout further includes the first and second roof rib panels, the first and second upper rib panels, and the first and second gable rib panels.

Figure 6:
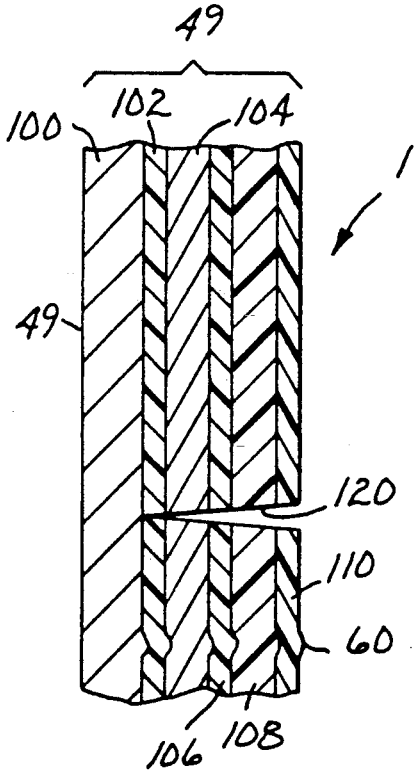
FIG. 6 is a magnified partial cross-sectional view along plane 6—6 of one of the upper rib panels of the container blank of FIG. 5 including a weakened line.

A magnified cross section of a portion of one of the first upper rib panel 49 is shown in FIG. 6. The container blank is generally constructed according to the aforementioned U.S. Pat. No. 4,787,507.

Outer layer 100 is constructed of cardstock, paperboard or any other suitable material. Layer 100 is primarily provided for structural support for the erected container. Layer 102 is an adhesive layer, preferably constructed of a heat sealable layer of a polyolefin such as polyethylene. Layer 104 is a layer of metallic foil, preferably aluminum foil, bonded by the layer 102 to the cardstock layer 100. Layer 104 also provides some mechanical support, but is primarily provided to act as a fluid barrier to separate the contents of the gable-top container from the environment. Layer 106 is a second layer of adhesive, preferably also a heat sealable layer of a polyolefin such as polyethylene. Layer 108 is a reinforcing layer, preferably a layer of polyester, bonded to layer 104 by adhesive layer 106. Layer 108 is provided as an additional strengthening layer. Finally, outermost layer 110 is a third adhesive layer, preferably another heat sealable layer of a polyolefin such as polyethylene. Layer 110 is provided for adhering the facing surfaces of the first and second upper rib panels 49 and 55, as well as all other opposing surfaces of the container blank when formed into a gable-top container during the erecting and sealing process previously described herein.

Figure 7:
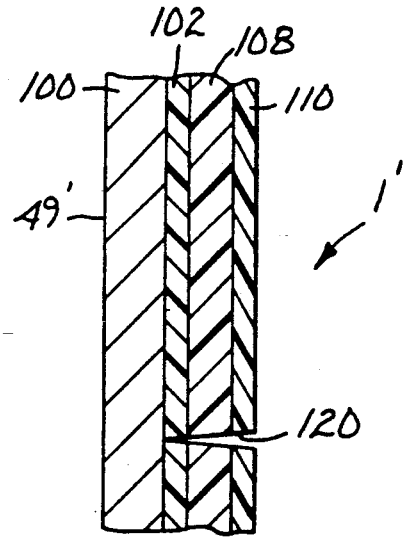
FIG. 7 is a magnified cross-sectional view of an alternate embodiment of the container blank of FIG. 5 including a weakened line.

FIG. 7 is a magnified cross section of one of an alternate embodiment 1' of a gable-top container having a construction substantially identical to that shown in FIG. 6, with the exception that layers 108 and 110 have been omitted. This represents a construction closer to gable-top containers commonly marketed in the past. It is to be understood therefore, that the present invention is applicable to the widest possible variety of embodiments of gable-top containers, including those depicted in FIGS. 6 and 7, as well as any other configuration found advantageous for a particular application.

Figure 8:
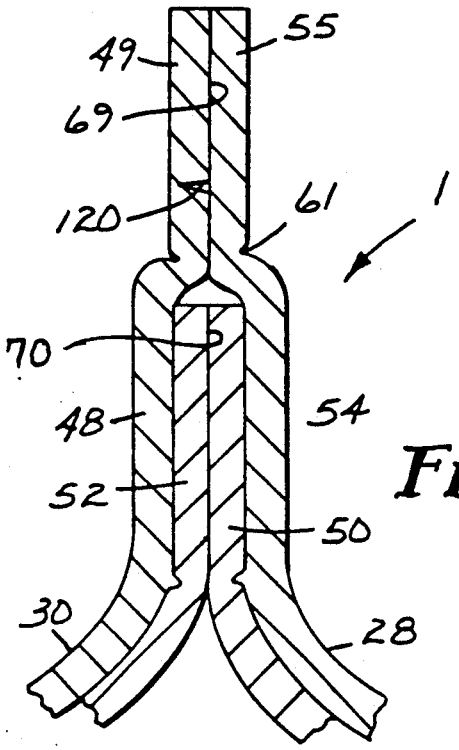
FIG. 8 is a partial cross-sectional view along plane 8—8 of the upper portion of the sealed gable-top container of FIG. 1.
Figure 9:
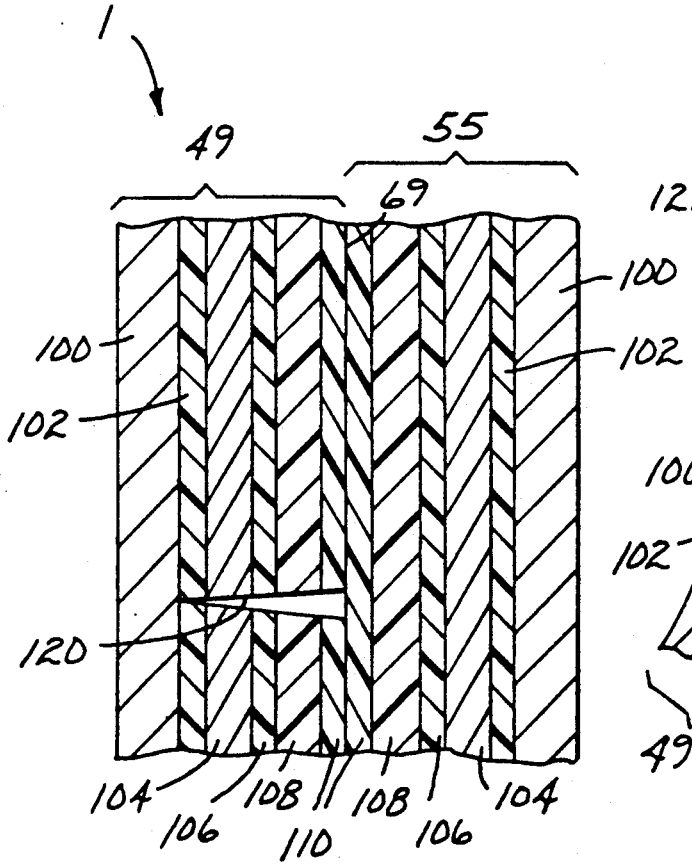
FIG. 9 is a magnified partial cross-sectional view of the gable-top container of FIGS. 1 and 8 with the first and second upper rib panels bonded together.

FIGS. 8 and 9 illustrates a portion of the juncture of the first and second upper rib panels 49 and 55 when they are bonded together (as is shown from the exterior of the gable-top container in FIG. 1). As is shown more particularly in FIG. 9, respective layers 110 of the first and the second upper rib panels are bonded together as previously described. In conventional gable-top containers, the opening process requires the separation of the respective layers 110 in order to separate the first and the second upper rib panels 49 and 55, or alternatively, uncontrolled delamination of the upper rib panels. The first approach tends to increase the opening force to an unacceptically high level and the second approach provides a pouring spout with an unappealing appearance. Means are provided in the present invention to reduce the force required to open the pouring spout of the gable-top container by inducing a controlled delamination of the cardstock layer of at least one of the upper rib panels. This approach reduces the opening force required by obviating the need to separate the facing heat sealing adhesive layers 110 of the upper rib panels, yet prevents unacceptable damage to the pouring spout panels.

The force reducing means includes a weakened line 120 formed in at least one of the facing inner surfaces of the first and the second upper rib panels (shown as upper rib panel 49 in FIGS. 6–9). Preferably, the weakened line is located parallel and adjacent to the score lines 60 and 61, respectively, separating the first and the second upper rib panels and the first and second roof rib panels 48 and 54. Most preferably, the weakened line extends from the respective edges of the first and the second upper rib panels nearest to tip 51, to at least past a point aligned with the outermost corner of the third and fourth roof wing panels 40 and 43.

As is shown in FIGS. 6, 7 and 9, the weakened line 120 is formed by partially cutting through the thickness of the upper rib panel 49. Preferably, the weakened line penetrates layers 110, 108, 106, 104 and 102 to the innermost surface of cardstock layer 100. At a minimum, in the embodiment shown in FIG. 6, it is preferable that the weakened line 120 penetrate through the polyester layer 108, because of the increased tear resistance it imparts to the container blank. However, it is within the spirit and scope of the present invention for the weakened line 120 to penetrate to any desired depth with the laminate forming the gable-top container, provided that the weakened line does not penetrate completely though the container material.

Any suitable method may be devised for constructing the weakened line in a gable-top container according to the present invention. For instance, the container blank, as shown in FIG. 4, may be conveyed past a point at which a rotating blade (not shown) is positioned to cut a weakened or scored line in the inner surface of the container blank in the location shown and at the desired depth. Alternatively, a knife blade or similar instrument (not shown) may be mounted for reciprocal movement perpendicular to a stationary container blank. The blade is constructed with the desired length and is pressed against the container blank so as to penetrate to the desired depth in forming the weakened line.

Figure 5:
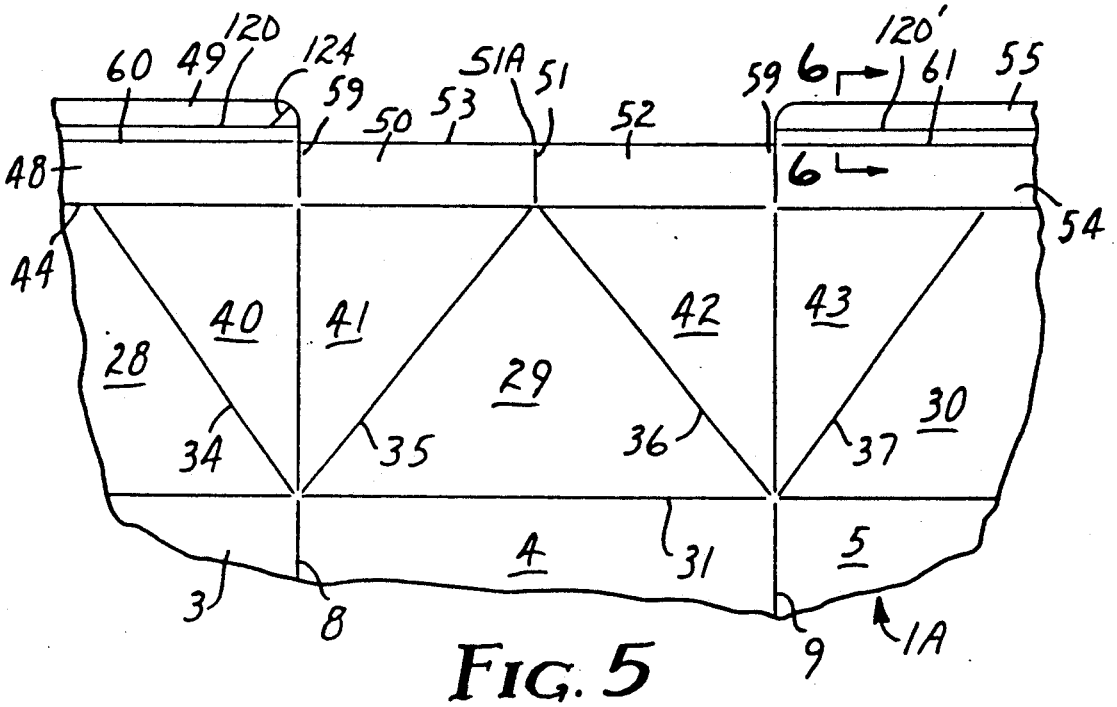
FIG. 5 is an enlarged plan view of the container blank of FIG. 4.

Although the preferred embodiment of the invention includes a weakened line formed in one of the first and second upper rib panels, it is within the spirit and scope of this invention to provide weakened lines in both upper rib panels (120 and 120' as shown in FIGS. 4 and 5). Preferably, the weakened lines would be aligned and the particular one of the upper rib panels that internally delaminates would be determined by the random variations in the strengths of materials and bonding forces adhering the upper rib panels together. It has been found that if the weakened lines are not aligned, that the delamination occurs at the lower weakened line (e.g. closest to the score lines 60 or 61).

Alternative arrangements for the weakened lines may be employed. For instance, the weakened line may be take the form of a perforated line. Alternatively, an additional score line may be pressed into the inner surface of one of the upper rib panels, without penetrating the material of the container blank, in place of a line partially cut into the container blank. Multiple weakened lines may be formed in the inner surface of one of upper rib panels to enhance the internal delamination of the upper rib panels. The multiple weakened lines may be parallel and spaced from the score line connecting the upper rib panel to the adjacent roof rib panel. However, as shown in FIG. 5, an additional weakened line 124 may be formed in the inner surface of an upper rib panel that is inclined and directed downwardly towards and preferably is connected to the weakened line 120. Most preferably the weakened line is inclined downwardly (towards score line 60) at approximately a 45° angle with respect to the weakened line 120. This arrangement has been found to enhance the delamination of the upper rib panel.

Figure 10:
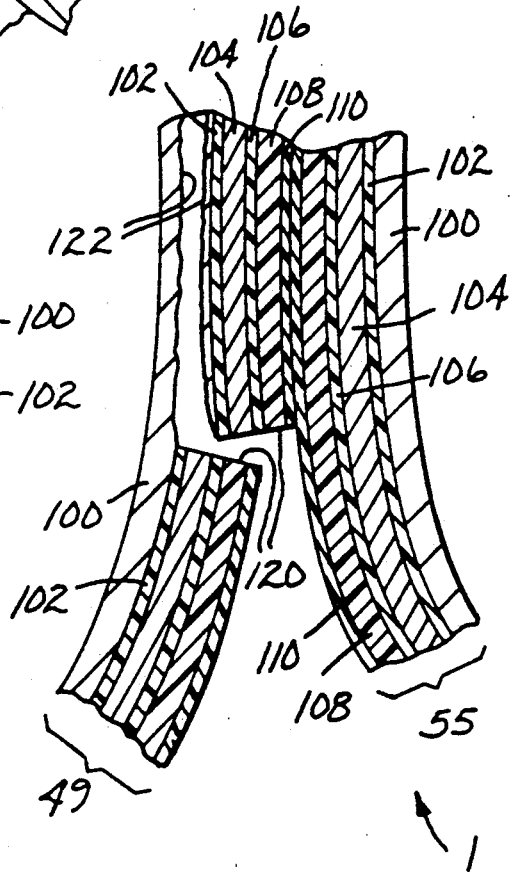
FIG. 10 is a magnified partial cross-sectional view of the gable-top container of FIG. 9, with the first and second upper rib panels separated after bonding.

The formation of the weakened line 120 in one of the facing surfaces of the first or the second upper rib panels 49 and 55 will not interfere or alter in any way the erection and sealing of a gable-top container as previously described. However, upon opening of the sealed gable-top container, in the first phase of separating the reciprocally adhered facing pouring spout panels, an internal delamination of the one of the first or the second upper rib panels that includes the weakened line 120 is induced, as is shown in FIG. 10. The force required to internally delaminate one of the upper rib panels is substantially less than the force required to separate the reciprocally adhered layers 110.

As is also shown in FIG. 10, the internal delamination of the upper rib panel begins at the weakened line 120 and continues upwardly to the upper most edge of the first upper rib panel. Further, the delamination continues past the end of the weakened line 120 to the edge of the first and second upper rib panels farthest away from the tip 51. Thus, the majority of the upper rib panel with the weakened line is detached and remains with the other of the upper rib panels as the pouring spout is opened, and a minor portion below the weakened line 120 remains on intact. The internal delamination occurs within cardstock layer 100 and creates two complementary surfaces 122 in the opened pouring spout. Since the delamination occurs in a controlled manner, excessive damage to the pouring spout panels is prevented.

It will be appreciated that uncontrolled delamination will not ensure reduced opening forces, as the depth of the delamination may vary with random variations in the bond strengths or strength of materials within the upper rib panels. Also, delamination may extend beyond the upper rib panels, into other pouring spout panels, which is undesirable. Of course, the weakened line could be constructed to induce delamination within or between any of the other layers of the gable-top container of this invention by controlling the selection of materials and the depth of penetration of the weakened line.

It is thus one of the advantages of this invention that the delamination occurs in a controlled manner. This enables the force required to open the pouring spout, by selecting the materials of the gable top container carefully and the bond strengths between layers and also the bond strength between the facing upper rib panels, such as by controlling the time, pressure, and temperature sealing process. An effective seal may be achieved with a reduced opening force. A wider variety of materials and thicknesses may be utilized then in part gable-top constructions to achieve greater protection of the contents of the container and/or to extend shelf life.

The following are non-limiting examples of gable-top containers constructed according to the present invention and according to the prior art:

EXAMPLE 1

Example 1 was a gable-top container as shown in FIG. 6 marketed under the trademark "Tetra Rex" by Tetra Pak U.S., Inc. of Shelton, Conn. and corresponding to U.S. Pat. No. 4,787,507. The cardstock layer (100 in FIG. 6) was 0.022" (0.56 mm) thick, the first adhesive layer (102) was a 0.0005" inch (0.013 mm) thick layer of polyethylene. A 0.0004 (0.012 mm) inch layer of aluminum foil (104) was adhered to the polyethylene layer (102). A 0.0003 inch (0.076 mm) to 0.0004 (0.012 mm) thick layer of carboxylated polyethylene (EAA) (106) was adhered to the opposite side of the aluminum foil. A 0.0005 inch (0.013 mm) thick layer of polyester film (108) having a melting point of approximately 254° C. was applied to the opposite side of the polyethylene layer (106). Finally, a 0.0012 inch (0.030 mm) thick layer of polyethylene (110) having a melting temperature of 109.2° C. was adhered to the opposite side of the layer of polyester. The container blank was constructed for a ½ gallon (1.89 liter) gable-top container. A 1.0 inch (2.5 cm) by 2.75 inch (4.45 cm) segment of unoriented polypropylene tape available from the Minnesota Mining and Manufacturing Company of St Paul, Minn. under the trademark "YR-8921" was adhered to the inner surfaces of the first and second gable rib panels, the first and second foldback panels and the first triangular end panel according to FIG. 10 of U.S. Pat. No. 4,712,727, the contents of which are incorporated herein by reference. The first and second upper rib panels were 0.25 inches (6.4 mm) by 3.7 inches (94 mm). The gable-top container was erected and sealed at a temperature of 300° F. (149° C.) The container was then opened with a spring gauge attached to measure the initial force to start the opening, and the continuing force to complete the first phase of the opening process. The opening force to extend the pouring spout panels forward to open the pouring spout during the second phase was likewise measured. A sample of ten (10) gable-top containers were opened, with an average initial opening force observed of 9.9 pounds (4.5 kg), an average continuing opening force of 9.1 pounds (4.1 kg) and an average opening force for the second phase of 5.8 pounds (2.6 kg).

EXAMPLE 2

Example 2 was constructed as in Example 1 according to FIG. 7, with the polyester layer (108) and the polyethylene layer (106) omitted. A sample of ten (10) gable-top containers were opened, with an average initial opening force observed of 8.4 pounds (3.8 kg), an average continuing opening force of 7.0 pounds (3.2 kg) and an average opening force for the second phase of 5.8 pounds (2.6 kg).

EXAMPLE 3

Example 3 was a gable-top container constructed as in Example 1, with a weakened line in the form of a slit cut into the container blank to the cardstock layer as in FIG. 6. The slit was 2.0 (5.1 cm) inches long and parallel to and spaced from the score line 60 in FIG. 6 by a distance of 0.2 inches (0.5 cm). The gable-top container was erected and sealed as in Example 1. A sample of ten (10) gable-top containers were opened, with an average initial opening force observed of 9.8 pounds (4.4 kg), an average continuing opening force of 7.0 pounds (3.2 kg) and an average opening force for the second phase of 3.7 pounds (1.7 kg).

EXAMPLE 4

Example 4 was a gable-top container constructed as in Example 2, with a weakened line in the form of a slit cut into the container blank to the cardstock layer as in FIG. 6. The slit was 2.0 (5.1 cm) inches long and parallel to and spaced from the score line 60 in FIG. 6 by a distance of 0.2 inches (0.5 cm). The gable-top container was erected and sealed as in Example 1. A sample of ten (10) gable-top containers were opened, with an average initial opening force observed of 9.0 pounds (4.1 kg), an average continuing opening force of 6.9 pounds (3.1 kg) and an average opening force for the second phase of 5.8 pounds (2.6 kg).

EXAMPLE 5

Example 5 was a gable-top container constructed as in Example 2, except with a weakened line in the form of a perforated line cut into the container blank to the cardstock layer as in FIG. 6. The perforated line was 2.0 (5.1 cm) inches long and parallel to and spaced from the score line 60 in FIG. 6 by a distance of 0.2 inches (0.5 cm). The perforations were 0.1 inches (2.5 mm) long and regularly spaced by a distance of 0.2 inches (0.5 mm). The gable-top container was erected and sealed as in Example 1. A sample of ten (10) gable-top containers were opened, with an average initial opening force observed of 10.0 pounds (0.45 kg), an average continuing opening force of 6.9 pounds (3.1 kg) and an average opening force for the second phase of 3.0 pounds (1.3 kg).

EXAMPLE 6

Example 6 was a gable-top container as in Example 3, except that the weakened line was cut 0.1 inch (2.5 mm) from the top of the upper rib panel. A sample of ten (10) gable-top containers were opened, with an average initial opening force observed of 10.1 pounds (4.6 kg), an average continuing opening force of 8.0 pounds (3.6 kg) and an average opening force for the second phase of 4.9 pounds (2.2 kg).

EXAMPLE 7

Example 7 was a gable-top container as in Example 3, except that the weakened line was cut 0.2 inch (5.1 mm) from the top of the upper rib panel. An additional weakened line was cut at a 45° angle inclined downward as in FIG. 5. A sample of ten (10) gable-top containers were opened, with an average initial opening force observed of 9.7 pounds (4.4 kg), an average continuing opening force of 7.5 pounds (3.4 kg) and an average opening force for the second phase of 4.6 pounds (2.1 kg).

EXAMPLE 8

Example 8 was a gable-top container as in Example 3, except that four parallel horizontal weakened lines 2.0 inches (5.1 cm) long were cut 0.1 inch (2.5 mm); 0.2 inch (5.1 mm); 0.3 inch (7.6 mm); and 0.4 inch (10.2 mm), respectively from the top of the upper rib panel.

EXAMPLE 9

Example 9 was a gable-top container as in Example 3, except that a horizontal weakened line 2.0 inches (5.1 cm) long was cut 0.1 inch (2.5 mm) from the top of one upper rib panel and another horizontal weakened line was cut 0.2 inch (5.1 mm) from the top of the other upper rib panel. After the gable-top container was erected, sealed and opened, it was observed that the delamination occurred on the upper rib panel with the lower weakened line.

It is to be understood, for the purposes of this invention, that the means for inducing internal delamination in one of the upper rib panels to reduce the opening force of the gable-top container may be utilized in any gable-top container construction, regardless of the particular arrangement, size or shape of panels, provided that a pouring spout is included having first and second upper rib panels or equivalent components for forming the uppermost ridge of a gable-top structure.

The present invention has now been described with reference to several embodiments thereof. It will be apparent to those skilled in the art that many changes can be made in the embodiments described without departing from the scope of the present invention. Thus, the scope of the present invention should not be limited to the structures described in this application, but only by structures described by the language of the claims and the equivalents of those structures.

What is claimed is:

1. A gable-top container having a thermoplastic inner surface coating, said container comprising:

(a) four body section panels including front and back panels and first and second side panels;

(b) bottom closure panel means for closing the bottom of said container;

(c) first and second oppositely disposed roof panels connected to the upper edges of said first and second side panels, respectively;

(d) first and second opposed substantially triangular end panels connected to the upper edges of said front and back body section panels, respectively, and extending upwardly therefrom;

(e) first and second foldback panels, said first foldback panel connected to said first roof panel and to one lateral edge of said first triangular end panel, and said second foldback panel connected to said second roof panel and to the other lateral edge of said first triangular end panel;

(f) third and fourth foldback panels, said third foldback panel connected to said first roof panel and to one lateral edge of said second triangular end panel, and said fourth foldback panel connected to the other lateral edge of said second triangular end panel and connected to said second roof panel;

(g) first and second gable rib panels connected to the upper edges of said first and second foldback panels, respectively, and extending upwardly therefrom, and to each other at a common line;

(h) third and fourth gable rib panels connected to the upper edges of said third and fourth foldback panels, respectively, and to each other;

(i) first and second roof rib panels connected to the upper edges of said first and second roof panels, respectively, each said roof rib panel connected at one side thereof to one of said first and second gable rib panels;

(j) first and second upper rib panels connected to the upper edges of said first and second roof rib panels, respectively;

(k) first roof wing panel comprising a triangular portion of said first roof panel adjoining said first foldback panel and said first roof rib panel and connected thereto;

(l) second roof wing panel comprising a triangular portion of said second roof panel adjoining said second foldback panel and said second roof rib panel, and connected thereto;

(m) said first triangular end panel, said first and said second foldback panels, said first and said second roof wing panels, said first and said second gable rib panels, said first and said second roof rib panels, and said first and said second upper rib panels forming an extensible pouring spout for dispensing the contents of the containers, and said uppermost end of said first triangular end panel and said first and second foldback panels forming a tip of said pouring spout; and (n) means for inducing controlled delamination of one said first and said second upper rib panels when said pouring spout is being opened to reduce the force required to open said pouring spout.

2. The gable-top container of claim 1, wherein said means for inducing delamination includes a weakened line formed in a facing inner surface in one of said first and second upper rib panels, wherein when said first and said second upper rib panels are separated, a portion of said upper rib panel above said weakened line delaminates and remains adhered to said other upper rib panel so as to reduce the force for separating said first and second upper rib panels from each other.

3. The gable-top container of claim 2, wherein said weakened line is a slit cut into said facing inner surface of one of said first and said second upper rib panels.

4. The gable-top container of claim 2, wherein said weakened line is a perforated line cut into said facing inner surface of one of said first and said second upper rib panels.

5. The gable-top container of claim 2, wherein said weakened line is a scored line pressed into said facing inner surface of one of said first and said second upper rib panels.

6. The gable-top container of claim 2, wherein said weakened line extends parallel to and spaced from said roof rib panels adjacent said one of said upper rib panels.

7. The gable-top container of claim 6, wherein said weakened line extends from an edge of said one of said upper rib panels closest said tip of said pouring spout to a point at least to a corner of said adjacent roof wing panel.

8. The gable-top container of claim 2, further including another weakened line formed in said other of said upper rib panels.

9. The gable-top container of claim 8, wherein both of said weakened lines are aligned when the gable-top container is closed and sealed.

10. The gable-top container of claim 2, further including a second weakened line formed in said one of said upper rib panels at an angle with respect to said first weakened line to facilitate the controlled delamination of said upper rib panel.

11. A gable-top container having a thermoplastic inner surface coating, said container comprising:

(a) a container body having sides, a bottom and a top;

(b) an extensible pouring spout including a generally triangular end panel connected to said container body top and extending upwardly therefrom, first and second foldback panels, said first foldback panel connected to said container body top and to one lateral edge of said first triangular end panel, and said second foldback panel connected to said container body top and to the other lateral edge of said first triangular end panel, first roof wing panel adjoining said first foldback panel and connected thereto, a second roof wing panel adjoining said second foldback panel and connected thereto, a first roof rib panel connected to said first roof panel and said first roof wing panel, a second roof rib panel connected to said second roof panel)and said second roof wing panel, a first upper rib panel connected to an upper edge of said first roof rib panel and a second upper rib panel connected to an upper edge of said second roof rib panel;

(c) said uppermost end of said first triangular end panel and said first and second foldback panels forming a tip of said pouring spout; and (d) means for inducing controlled delamination of one of said first and said second upper rib panels when said pouring spout is being opened to reduce the force required to open said pouring spout.

12. The gable-top container of claim 11, wherein said means for inducing delamination includes a weakened line formed in a facing inner surface in one of said first and second upper rib panels, wherein when said first and said second upper rib panels are separated, a portion of said upper rib panel above said weakened line delaminates and remains adhered to said other upper rib panel so as to reduce the force for separating said first and second upper rib panels from each other.

13. The gable-top container of claim 12, wherein said weakened line is a slit cut into said facing surface of one of said first and said second upper rib panels.

14. The gable-top container of claim 12, wherein said weakened line is a perforated line cut into said facing inner surface of one of said first and said second upper rib panels.

15. The gable-top container of claim 12, wherein said weakened line is a scored line pressed into said facing inner surface of one of said first and said second upper rib panels.

16. The gable-top container of claim 12, wherein said weakened line extends parallel to and spaced from said gable rib panels adjacent said one of said upper rib panels.

17. The gable-top container of claim 16, wherein said weakened line extends from an edge of said one of said upper rib panels closest said tip of said pouring spout to a point at least to a corner of said adjacent roof wing panel.

18. The gable-top container of claim 12, further including another weakened line formed in said other of said upper rib panels.

19. The gable-top container of claim 18, wherein both of said weakened lines are aligned when the gable-top container is closed and sealed.

20. The gable-top container of claim 12, further including a second weakened line formed in said one of said upper rib panels at an angle with respect to said first weakened line to facilitate the controlled delamination of said upper rib panel.

21. A sheet material blank for constructing a sealed gable-top container with a thermoplastic inner surface coating responsive to a container sealing process, comprising:

(a) four body section panels including front and back panels and first and second side panels;

(b) bottom closure panel means for closing the bottom of said container;

(c) first and second oppositely disposed roof panels connected to the upper edges of said first and second side panels, respectively;

(d) first and second opposed substantially triangular end panels connected to the upper edges of said front and back body section panels, respectively, and extending upwardly therefrom;

(e) first and second foldback panels, said first foldback panel connected to said first roof panel and to one lateral edge of said first triangular end panel, and said second foldback panel connected to said second roof panel and to the other lateral edge of said first triangular end panel;

(f) third and fourth foldback panels, said third foldback panel connected to said first roof panel and to one lateral edge of said second triangular end panel, and said fourth foldback panel connected to the other lateral edge of said second triangular end panel and connected to said second roof panel;

(g) first and second gable rib panels connected to the upper edges of said first and second foldback panels, respectively, and extending upwardly therefrom, and to each other at a common line;

(h) third and fourth gable rib panels connected to the upper edges of said third and fourth foldback panels, respectively, and to each other;

(i) first and second roof rib panels connected to the upper edges of said first and second roof panels, respectively, each said roof rib panel connected at one side thereof to one of said first and second gable rib panels;

(j) first and second upper rib panels connected to the upper edges of said first and second roof rib panels, respectively;

(k) first roof wing panel comprising a triangular portion of said first roof panel adjoining said first foldback panel and said first roof rib panel and connected thereto;

(l) second roof wing panel comprising a triangular portion of said second roof panel adjoining said second foldback panel and said second roof rib panel, and connected thereto;

(m) said first triangular end panel, said first and said second foldback panels, said first and said second roof wing panels, said first and said second gable rib panels, said first and said second roof rib panels, and said first and said second upper rib panels forming an extensible pouring spout for dispensing the contents of the containers, and said uppermost end of said first triangular end panel and said first and second foldback panels forming a tip of said pouring spout; and (n) a weakened line formed in said inner surface of one of said first and second upper rib panels, wherein when the container blank is formed into a sealed gable-top container and said inner surfaces of said first and said upper rib panels are adhered to each other and then separated as the gable-top container is opened, a portion of said upper rib panel with said weakened line delaminates in a controlled manner and remains adhered to said other upper rib panel so as to reduce the force for separating said first and second upper rib panels from each other and to reduce the force required to open said pouring spout.

22. The sheet material blank of claim 21, wherein said weakened line is a slit cut into said inner surface of one of said first and said second upper rib panels.

23. The sheet material blank of claim 21, wherein said weakened line is a perforated line cut into said inner surface of one of said first and said second upper rib panels.

24. The sheet material blank of claim 21, wherein said weakened line is a scored line pressed into said inner surface of one of said first and said second upper rib panels.

25. The sheet material blank of claim 21, wherein said weakened line extends parallel to and spaced from said roof rib panel adjacent said one of said upper rib panels.

26. The sheet material blank of claim 25, wherein said weakened line extends from an edge of said one of said upper rib panels closest said tip of said pouring spout to a point at least to a corner of said adjacent foldback panel.

27. The sheet material blank of claim 21, further including a second weakened line formed in said inner surface of said other of said upper rib panels.

28. The sheet material blank of claim 21, further including a second weakened line formed in said inner surface of said one of said upper rib panels at an angle with respect to said first weakened line.

29. A method for constructing a gable-top container, comprising the steps of:

(a) providing a sheet material gable-top container blank including a container body having side panels, a bottom and a top and an extensible pouring spout including a generally triangular end panel connected to the container body top and extending upwardly therefrom, first and second foldback panels, the first foldback panel connected to the container body top and to one lateral edge of the first triangular end panel, and the second foldback panel connected to the container body top and to the other lateral edge of the first triangular end panel, a first roof wing panel adjoining the first foldback panel and connected thereto, a second roof wing panel adjoining the second foldback panel and connected thereto, a first roof rib panel connected to the first roof panel and the first roof wing panel, a second roof rib panel connected to the second roof panel and the second roof wing panel the uppermost end of the first triangular end panel and the first and second foldback panels forming a tip of the pouring spout, a first upper rib panel connected to an upper edge of the first roof rib panel and a second upper rib panel connected to an upper edge of the second roof rib panel;

(b) forming a weakened line in an inner surface of one of the first and second upper rib panels to induce controlled delamination of the first and the second upper rib panels as the pouring spout of the gable-top container is opened, to reduce the force required to open the gable-top container; and (c) forming the gable-top container blank into a gable-top container.

30. The method of claim 29, further comprising the step of:

(d) sealing the top of the gable-top container.

31. The method of claim 29, wherein said step of forming said weakened line includes the step of cutting a slit in the inner surface of the one of the first and the second upper rib panels.

32. The method of claim 29, wherein said step of forming said weakened line includes the step of pressing a scored line in the inner surface of the one of the first and the second upper rib panels.

33. The method of claim 29, wherein said step of forming said weakened line includes the step of cutting a perforated line in the inner surface of the one of the first and the second upper rib panels.

* * * * *